US007794213B2

(12) United States Patent
Gaude et al.

(10) Patent No.: US 7,794,213 B2
(45) Date of Patent: Sep. 14, 2010

(54) INTEGRATED ACOUSTIC DAMPER WITH THIN SHEET INSERT

(75) Inventors: Gladys Gaude, Golbey (FR); Thierry Lefévre, Dogenville (FR)

(73) Assignee: Honeywell International Inc., Morristown, NJ (US)

( * ) Notice: Subject to any disclaimer, the term of this patent is extended or adjusted under 35 U.S.C. 154(b) by 251 days.

(21) Appl. No.: 11/748,325

(22) Filed: May 14, 2007

(65) Prior Publication Data

US 2008/0286127 A1 Nov. 20, 2008

(51) Int. Cl.
*F04B 39/00* (2006.01)
*F01N 1/00* (2006.01)
*F01N 13/08* (2010.01)

(52) U.S. Cl. ..... 417/312; 181/250; 181/273; 181/276; 138/30

(58) Field of Classification Search ..... 181/212, 181/214, 225, 227, 229, 246, 250, 264, 266, 181/273, 276; 210/130; 415/55.6, 119, 143, 415/189, 204; 417/312
See application file for complete search history.

(56) References Cited

U.S. PATENT DOCUMENTS 1,663,998 A * 3/1928 Schmidt ..... 415/204
2,109,742 A * 3/1938 Fanning ..... 415/119
2,225,398 A * 12/1940 Hamblin ..... 415/119
2,936,014 A * 5/1960 Kraus et al. ..... 411/80.6
3,144,913 A * 8/1964 Bailey ..... 181/248
3,191,851 A * 6/1965 Wood ..... 415/119
3,346,174 A * 10/1967 Lievens et al. ..... 415/119
3,398,932 A * 8/1968 Koeller et al. ..... 415/47
3,976,393 A * 8/1976 Larson ..... 415/119
4,568,255 A * 2/1986 Lavender et al. ..... 417/477.8
4,692,091 A * 9/1987 Ritenour ..... 415/119
4,693,669 A * 9/1987 Rogers, Sr. ..... 415/143
5,215,433 A * 6/1993 Weiland et al. ..... 415/119
5,316,439 A * 5/1994 Gatley et al. ..... 415/119
5,581,055 A * 12/1996 Self et al. ..... 181/230
6,202,413 B1 * 3/2001 Baker et al. ..... 60/602
6,302,630 B1 * 10/2001 Grant ..... 411/372.6
6,688,425 B2 * 2/2004 Cole et al. ..... 181/264
7,017,706 B2 * 3/2006 Brown et al. ..... 181/256
7,066,715 B2 * 6/2006 Martin et al. ..... 415/203
2004/0238273 A1 * 12/2004 Fritskey et al. ..... 181/264

(Continued)

FOREIGN PATENT DOCUMENTS

DE 4219249 * 12/1993

(Continued)

OTHER PUBLICATIONS

Machine Translation of EP573895, Exhaust Gas Turbocharger with radial compressor[. . . ].*

*Primary Examiner*—Devon Kramer
*Assistant Examiner*—Nathan Zollinger
(74) *Attorney, Agent, or Firm*—Chris James; Brian Pangle

(57) ABSTRACT

An exemplary noise damper for a compressor of a turbocharger includes a compressor housing comprising a cavity substantially adjacent a gas flow surface of a conduit to a compressed gas outlet of the compressor housing and an insert that spans the cavity and forms a wall of the cavity where the wall includes one or more openings to the cavity to thereby allow acoustic energy to be damped by the cavity. Various other exemplary technologies are also disclosed.

13 Claims, 6 Drawing Sheets

U.S. PATENT DOCUMENTS

| | | | | |
|---|---|---|---|---|
| 2005/0067220 | A1* | 3/2005 | Keller et al. | 181/250 |
| 2008/0056882 | A1* | 3/2008 | Clay et al. | 415/55.6 |
| 2008/0292449 | A1* | 11/2008 | Lefevre | 415/58.4 |

FOREIGN PATENT DOCUMENTS

| | | | |
|---|---|---|---|
| DE | 19818873 | A1 | 11/1999 |
| DE | 19957597 | A1 | 5/2001 |
| DE | 10112764 | A1 | 9/2002 |
| EP | 1291570 | A2 | 12/2003 |
| EP | 1443217 | A2 | 8/2004 |
| EP | 1443217 | A3 | 10/2004 |
| EP | 1602810 | A1 | 12/2005 |
| GB | 2256460 | A * | 12/1992 |

* cited by examiner

INTEGRATED ACOUSTIC DAMPER WITH THIN SHEET INSERT

TECHNICAL FIELD

Subject matter disclosed herein relates generally to systems that include a compressor for intake air for an internal combustion engine.

BACKGROUND

Turbochargers produce aerodynamic noises that can annoy vehicle passengers as well as those in the surrounding environment. Such noises can propagate to other engine system components where acoustic energy may be detrimental and increase wear. In general, most people view turbocharger noise as a nuisance.

For a properly operating, conventional turbocharger, the intake air compressor and the exhaust turbine generate noise. Characteristics of generated noise typically change with operating conditions. For example, as a compressor moves toward surge (a non-optimal operating condition), noise generation can intensify due to flow separation at the suction side of the compressor blades. This noise can propagate through the high density compressed air as well as through structures connected to the compressor.

While turbocharger noise can lead to complaints, noise can also provide information as to particular issues associated with turbocharging (e.g., compressor wheel imbalance, etc.). However, upon inspection, most noise complaints are determined to be associated with normal turbocharger operation. Thus, techniques that reduce turbocharger noise have the potential to reduce not only complaints but also unwarranted service calls.

SUMMARY

An exemplary noise damper for a compressor of a turbocharger includes a compressor housing comprising a cavity substantially adjacent a gas flow surface of a conduit to a compressed gas outlet of the compressor housing and an insert that spans the cavity and forms a wall of the cavity where the wall includes one or more openings to the cavity to thereby allow acoustic energy to be damped by the cavity. Various other exemplary technologies are also disclosed.

BRIEF DESCRIPTION OF THE DRAWINGS

A more complete understanding of the various method, systems and/or arrangements described herein, and equivalents thereof, may be had by reference to the following detailed description when taken in conjunction with the accompanying drawings wherein.

DETAILED DESCRIPTION

Various exemplary methods, devices, systems, arrangements, etc., disclosed herein address issues related to technology associated with turbochargers. Turbochargers are frequently utilized to increase the output of an internal combustion engine. A turbocharger generally acts to extract energy from the exhaust gas and to provide energy to intake air, which may be combined with fuel to form combustion gas.

Figure 1:
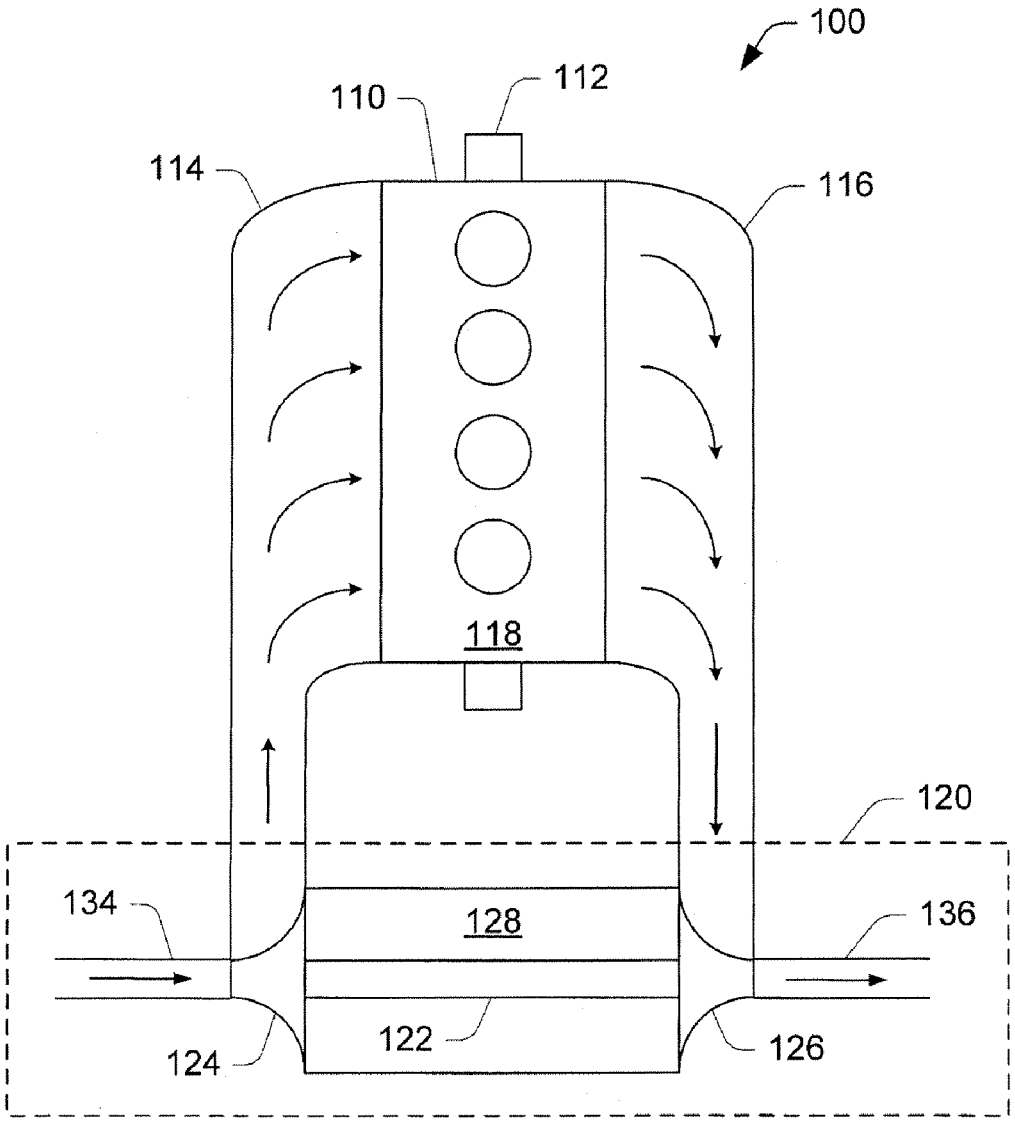
Fig. 1 (Prior Art)
FIG. 1 is a diagram of a conventional engine and turbocharger.

Referring to FIG. 1, a prior art system 100, including an internal combustion engine 110 and a turbocharger 120 is shown. The internal combustion engine 110 includes an engine block 118 housing one or more combustion chambers that operatively drive a shaft 112. As shown in FIG. 1, an intake port 114 provides a flow path for air to the engine block 118 while an exhaust port 116 provides a flow path for exhaust from the engine block 118.

The turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor unit 124, a turbine unit 126, a housing 128 and an exhaust outlet 136. The housing 128 may be referred to as a center housing as it is disposed between the compressor unit 124 and the turbine unit 126. The shaft 122 may be a shaft assembly that includes a variety of components.

Referring to the turbine unit 126, such a turbine unit optionally includes a variable geometry mechanism and a variable geometry controller. The variable geometry mechanism and variable geometry controller optionally include features such as those associated with commercially available variable geometry turbochargers (VGTs). Commercially available VGTs include, for example, the GARRETT® VNT™ and AVNT™ turbochargers, which use multiple adjustable vanes to control the flow of exhaust across a turbine. An exemplary turbocharger may employ wastegate technology as an alternative or in addition to variable geometry technology.

Some turbochargers include an electric motor operably coupled to a shaft to drive a compressor using electrical energy, for example, where exhaust energy alone is insufficient to achieve a desired level of boost. In some instances, a turbocharger may include a generator configured to generate electrical energy from exhaust gas.

Figure 2:
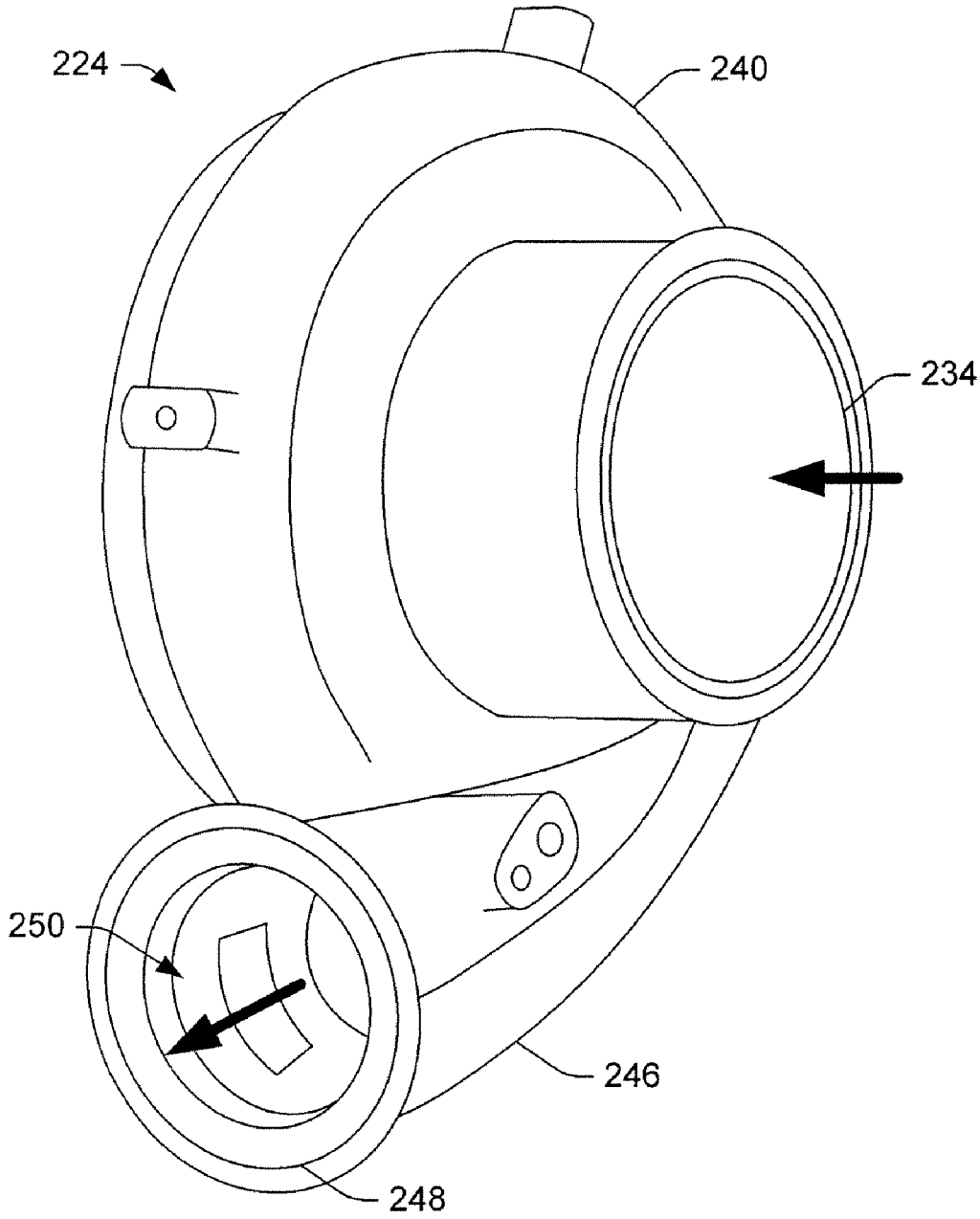
FIG. 2 is a perspective view of an exemplary compressor unit that includes a noise damper.

As mentioned in the background section, a turbocharger generates noise. FIG. 2 shows an exemplary compressor unit 224 suitable for use as the compressor unit 124 in the turbocharger 120 of FIG. 1. The compressor unit 224 includes a compressor housing 240 that houses a compressor wheel. The compressor housing 240 includes an inlet 234 (see, e.g., the inlet 134 of FIG. 1) and a compressor scroll extension 246 that leads to an outlet 248 for compressed gas (e.g., compressed air). In the example of FIG. 2, the compressor housing 240 includes a noise damper 250 located proximate to the outlet 248. The noise damper 250 acts to damp noise generated during operation of the compressor unit 224.

As the noise damper 250 is integral with the compressor housing 240, a manufacturer can ensure that a compressor installation will have certain noise characteristics. In turn, such characteristics may be helpful for investigating complaints or issues associated with turbocharger operation. While the noise damper 250 of FIG. 2 is shown as being integral with the compressor housing 240, various examples may implement a noise damper as an add-on. An exemplary compressor housing may include an inlet noise damper (e.g., proximate to the opening 234) as an alternative or in addition to an outlet noise damper.

Figure 3:
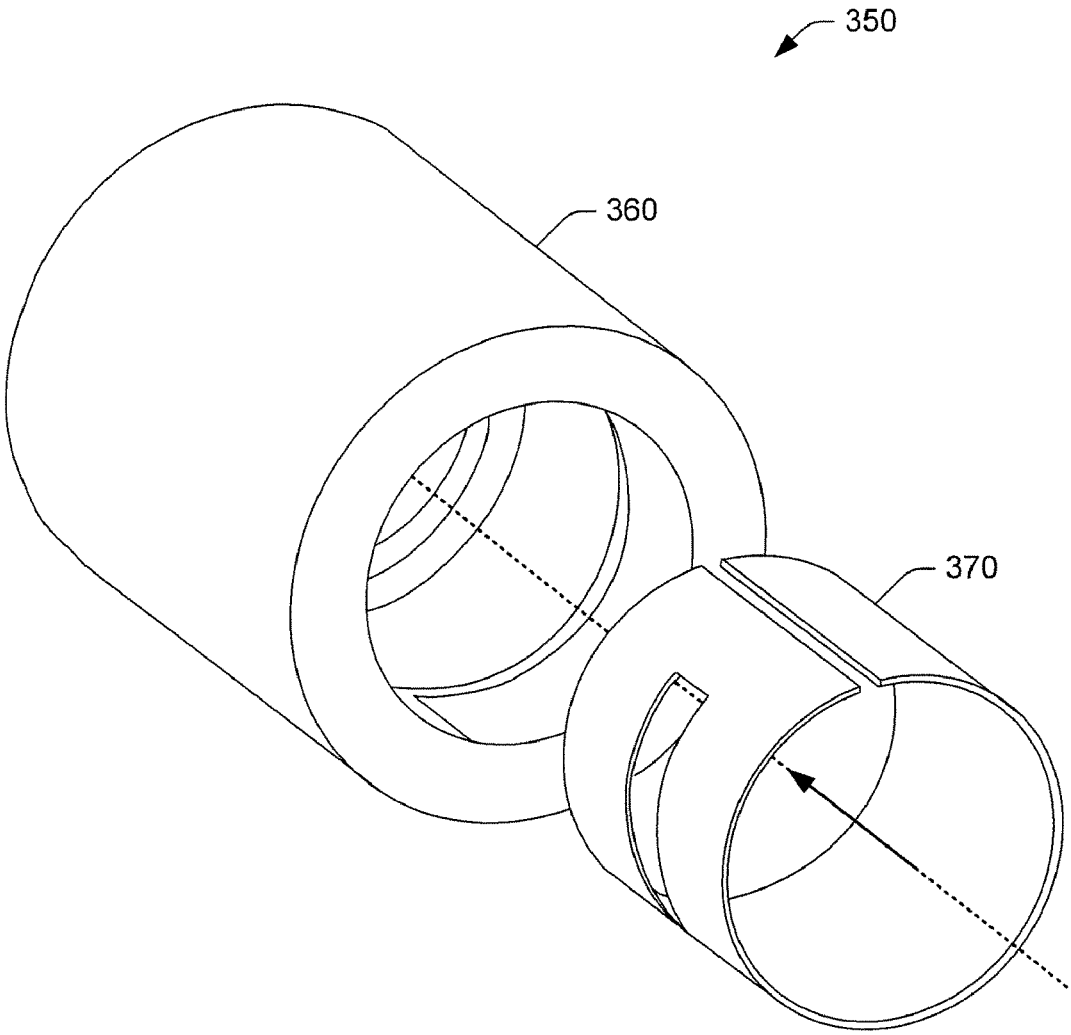
FIG. 3 is an exploded, perspective view of an exemplary noise damper for use with a compressor.

FIG. 3 shows a perspective view of an exemplary noise damper 350. The noise damper 350 includes a conduit 360 and an insert 370. The sleeve-like insert 370 fits into the lumen of the conduit 360 where, in combination with features of the conduit 360, it forms a noise damping cavity. The lumen of the conduit 360 is defined by a gas flow surface (e.g., an inner wall surface of the conduit). As shown in FIG. 3, the conduit 360 has a substantially cylindrical shape that defines a central axis and the insert 370 has a substantially cylindrical shape that defines a central axis. For assembly of the noise damper 350, the central axes of the conduit 360 and the insert 370 may be aligned and the insert 370 positioned (e.g., via sliding motion) into an appropriate location in the conduit 360 to thereby form one or more noise damping cavities.

The insert 370 may be a thin sheet (e.g., metal, plastic or composite material) that forms an inner wall of an acoustic damper section. Features or properties of the sheet can be tailored to provide accuracy as to damper characteristics and damper efficiency.

With respect to the noise damper 250 of FIG. 2, the scroll extension 246 of the compressor housing 240 may serve as the conduit 360 whereby an insert such as the insert 370 is slid into the compressor housing 240 via the opening 248 (e.g., the outlet of the compressor housing 240).

Figure 4:
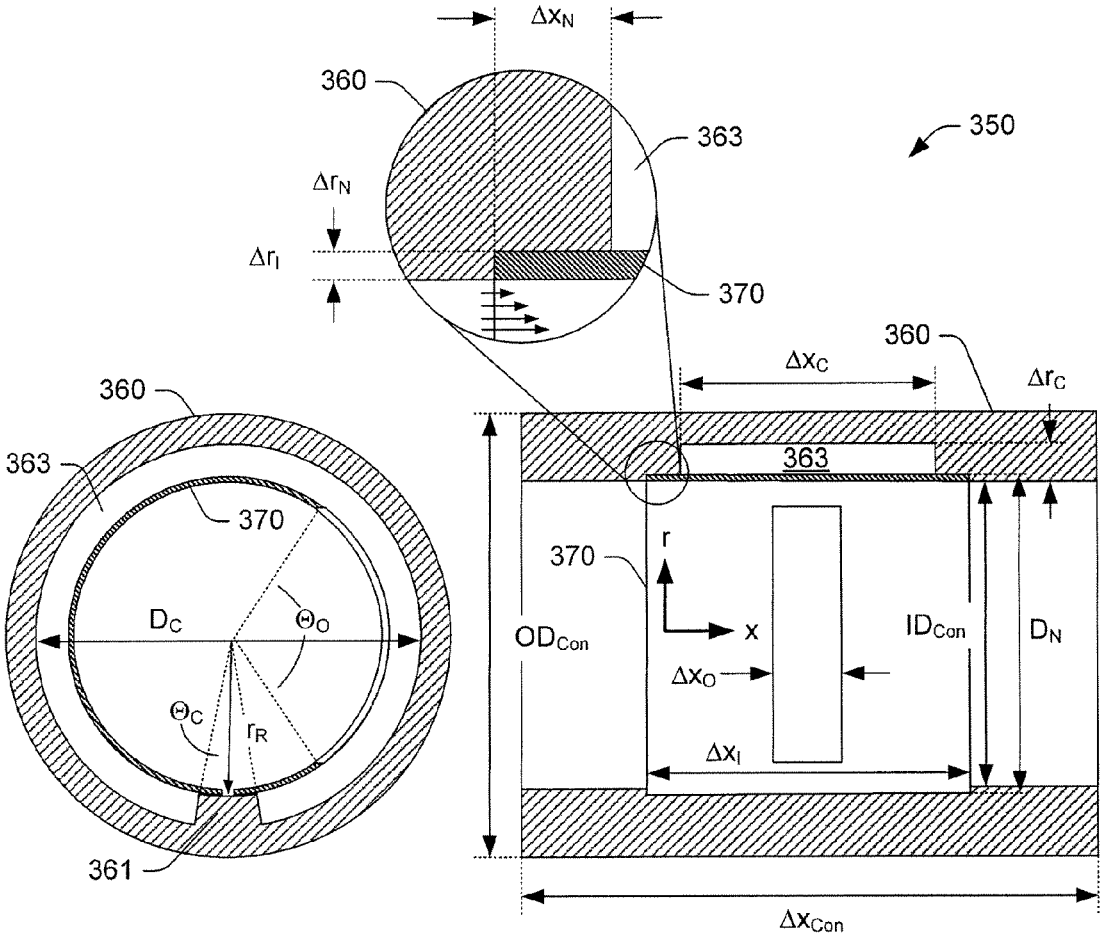
FIG. 4 is a series of cross-sectional views of the exemplary noise damper of FIG. 3.

FIG. 4 shows two cross-sectional views of the noise damper 350 of FIG. 3. One cross-sectional view is along the central axis and the other is orthogonal to the central axis. Various features of the noise damper 350 are explained with respect to a cylindrical coordinate system having a radial coordinate "r", an axial coordinate "x" and an azimuthal coordinate "Θ".

In the example of FIG. 4, the conduit 360 has an outer diameter "$OD_{Con}$", an inner diameter "$ID_{Con}$", a conduit axial length "$\Delta x_{Con}$", a cavity diameter "$D_C$", a notch diameter "$D_N$", a cavity radial depth "$\Delta r_C$", a notch radial depth "$\Delta r_N$", a cavity axial length "$\Delta x_C$", a notch axial length "$\Delta x_N$" (e.g., on both sides of the cavity) and a conduit ridge angle "$\Theta_C$". The conduit ridge angle $\Theta_C$ defines in part a conduit ridge 361 that supports the insert 370 along the span of the cavity $\Delta x_C$. The conduit ridge 361 has a surface at a radius "$r_R$" substantially the same as half the notch diameter $D_N$. The conduit ridge extends radially inward from the cavity diameter $D_C$ of the cavity 363.

When assembled, the insert 370 has an insert outer diameter "$OD_I$" that substantially matches the notch diameter $D_N$ and an insert inner diameter "$ID_I$" that substantially matches the conduit inner diameter $ID_{Con}$. The insert 370 also has an axial length "$\Delta x_I$" that substantially matches the cavity length $\Delta x_C$ plus twice the notch axial length $\Delta x_N$. Thus, upon assembly, the insert 370 forms a wall of a cavity 363 defined by the conduit 360 and provides openings to the cavity 363 that allow for acoustic energy damping.

A close-up view of the boundary between the conduit 360 and the insert 370 indicates how the inner diameter of the conduit 360 and the inner diameter of the insert 370 match to form a substantially continuous transition region along a flow surface (see, e.g., flow vectors).

As shown in FIG. 4, the conduit 360 and the insert 370 form a cavity accessible via a section of the insert 370 that includes one or more openings. In the example of FIG. 4, the insert 370 includes a single opening having an axial length "$\Delta x_O$" over an arc "$\Theta_O$" that can define an arc length dimension of the opening.

As described herein, an exemplary noise damper for a compressor of a turbocharger includes a compressor housing manufactured with a cavity substantially adjacent a gas flow surface of a conduit to a compressed gas outlet of the compressor housing and an insert that spans the cavity and forms a wall of the cavity where the wall includes one or more openings to the cavity to that allow acoustic energy to be damped by the cavity. As shown in FIG. 2, such a noise damper may be part of a scroll extension that extends from a compressor scroll to the compressed gas outlet of a compressor housing.

Where desirable, an exemplary noise damper may include a notch located directly adjacent a cavity and configured to secure an insert. For example, an insert may have a wall thickness and the notch a depth that matches the wall thickness of the insert to thereby form a substantially continuous transition between a gas flow surface of the conduit and the insert.

An exemplary noise damper may be made of a resilient material capable of being radially compressed, inserted into the lumen of a conduit and radially expanded to secure the insert in a location in the conduit that spans a cavity.

Referring again to FIG. 2, an exemplary compressor housing for a turbocharger can include a compressor scroll section, an outlet for compressed gas and a noise damper located in a conduit between the compressor scroll section and the outlet for compressed gas where the noise damper includes a cavity formed in part by the conduit and a resilient insert disposed in the conduit via the outlet where the resilient insert spans the cavity and includes one or more openings to the cavity.

An exemplary method for manufacturing a compressor housing that includes a noise damper includes casting a compressor housing where the compressor housing includes a compressor scroll, an outlet for compressed gas, a conduit between the compressor scroll and the outlet for compressed gas and a cavity located in a wall of the conduit and inserting a resilient insert into the conduit where the resilient insert spans the cavity and includes one or more openings to the cavity. In such a method, the process of inserting the insert can include compressing the resilient insert, inserting the resilient insert into the conduit via the outlet for compressed gas and allowing the resilient insert to expand in the conduit. As already mentioned, a compressor housing can include a ridge that spans a length of a cavity. According to such a configuration, a method can include supporting the resilient insert at least in part by the ridge.

Figure 5:
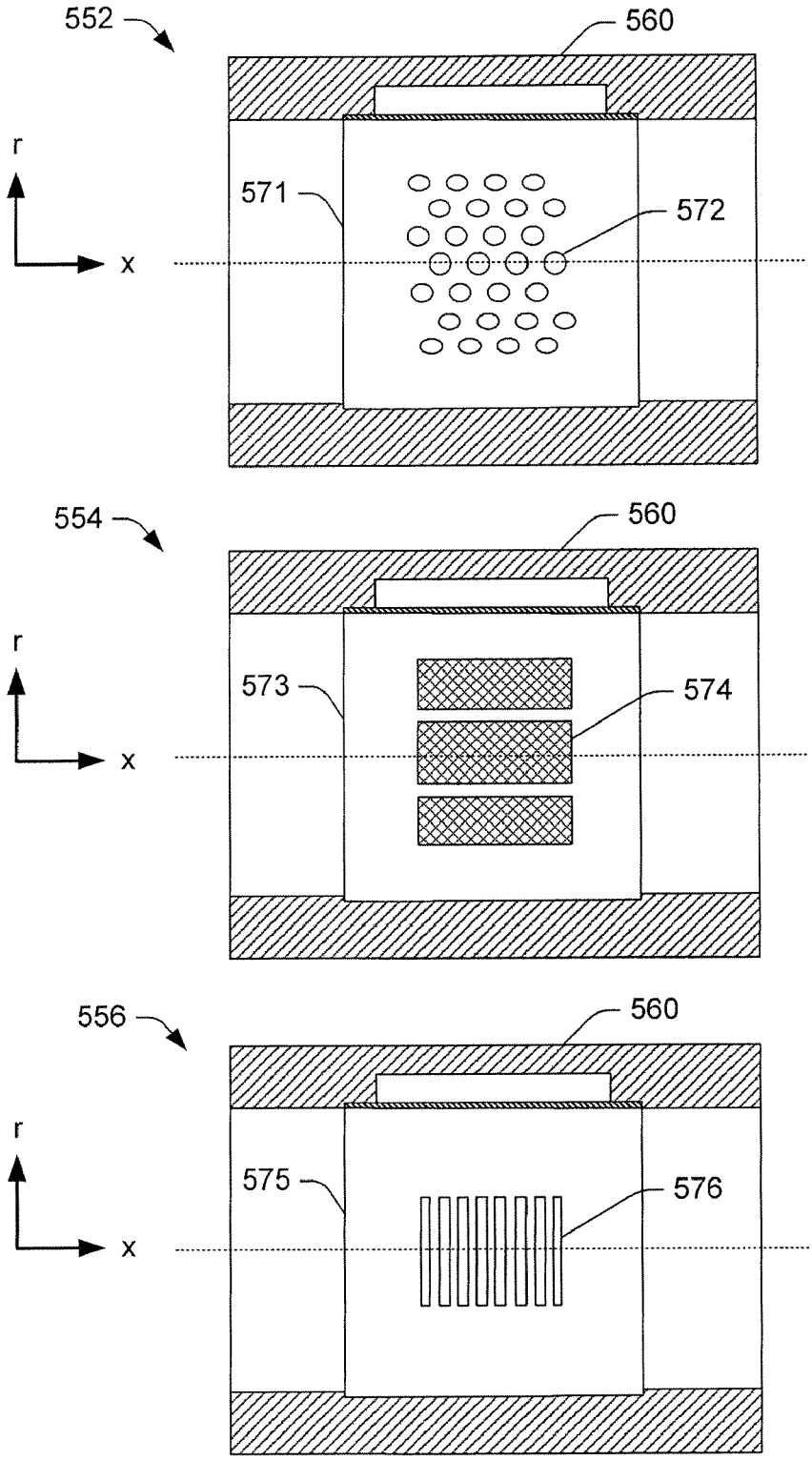
FIG. 5 is a series of cross-sectional views for noise dampers having various insert configurations.

FIG. 5 shows three different noise dampers 552, 554 and 556 where each noise damper includes a different insert configuration. The noise damper 552 includes a conduit 560 and an insert 571 that has a plurality of round or oval shaped openings 572. The noise damper 554 includes a conduit 560 and an insert 573 that has a plurality of porous mesh sections 574. The noise damper 556 includes a conduit 560 and an insert 575 that has a plurality of rectangular shaped openings 576. In the example 556, the rectangular shaped openings 576 are oriented with a long axis (e.g., length) orthogonal to the x-axis, which typically corresponds to the direction of flow. While openings may be oriented in any of a variety of manners, the orientation for the rectangular openings 576 of the example 556 may be considered a preferred orientation as the opening dimension along the flow direction is less than the opening dimension orthogonal to the flow direction. In addition, such an arrangement can help to maintain integrity of an insert with respect to the insert's radial shape (e.g., cylindrical shape).

As described herein, an exemplary insert can include one or more openings that include an arc length dimension that exceeds an axial dimension. Consider the insert 575 and the substantially rectangular openings 576 that include a length oriented orthogonal to a gas flow direction (x-axis) and an axial dimension (e.g., width) that is less than the length.

Referring to the compressor housing 240, such a housing is optionally cast with one or multiple chambers in the compressor scroll extension section 246 to provide appropriate damper cavity volumes.

To form one or more dampers, one or more thin sheets can be rounded to form a substantially cylindrical form that may be of a slightly larger diameter than the inner diameter of the compressor scroll extension section 246 where the cavity(ies) exist. As indicated in various examples, a thin sheet need not be completely closed to thereby allow reduction of its diameter under an applied force and to extend to a larger diameter when released in its appropriate location. Assembly may compress and then release a thin sheet in the compressor scroll extension section of a compressor housing. Such a thin sheet stays in place by the fact that its diameter is slightly larger than the diameter where it is fitted (e.g., consider a compressible/expandable retaining ring). In other examples, an insert may be made from a resilient material (e.g., optionally memory material) that can be shaped for insertion and then expanded (e.g., via heat application, natural resiliency, etc.) to fit snugly into the proper location.

As indicated in FIG. 5, a thin sheet or "sleeve" may be perforated with holes (see, e.g., the openings 572). Holes or openings may be long and rectangular or little circles or any other forms allowing acoustic efficiency. The size and number of the holes can be tailored depending on turbocharger size and type of noise. The thickness of a sheet can depend on damper properties required or desired for reducing turbocharger compressor noise.

As described herein, a sleeve may form a cavity wall in a conduit where the sleeve is fixed by its own stiffness (e.g., like a spring). Such an arrangement of can ease manufacturability and allow for a variety of design not readily achievable by machining or casting.

Figure 6:
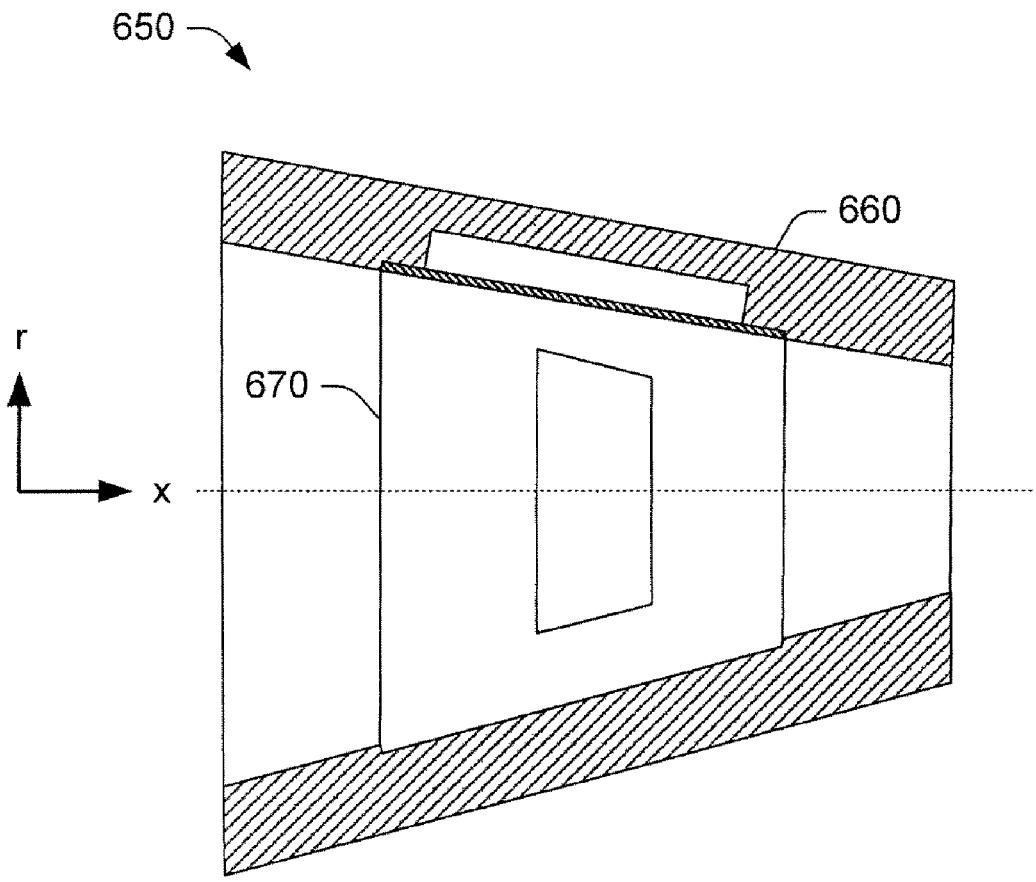
FIG. 6 is a cross-sectional view of a noise damper that has a varying conduit cross-sectional flow area (e.g., diameter) along a length of the conduit.

FIG. 6 shows an exemplary noise damper 650 where a conduit 660 and an insert 670 have shapes that vary along the length of the conduit 660. For example, in the compressor housing 240 of FIG. 2, the scroll extension section 246 may have a diameter that increases approaching the opening 248 (i.e., the compressor outlet). In such circumstances, an insert may be formed to match the diameter, as appropriate. Installation of the insert 670 in the conduit 660 to form the damper 650 may occur via the left hand side (e.g., larger diameter portion) of the conduit 660.

Although exemplary methods, devices, systems, etc., have been described in language specific to structural features and/or methodological acts, it is to be understood that the subject matter defined in the appended claims is not necessarily limited to the specific features or acts described. Rather, the specific features and acts are disclosed as exemplary forms of implementing the claimed methods, devices, systems, etc.

The invention claimed is:

1. A tailorable noise damper for a compressor of a turbocharger, the noise damper comprising:

a compressor housing comprising a cavity substantially adjacent to a gas flow surface of a conduit to a compressed gas outlet of the compressor housing wherein the conduit comprises a scroll extension that extends from a compressor scroll to the compressed gas outlet; and an insert configured for insertion completely into the conduit via the gas outlet to span the cavity and form a wall of the cavity wherein the wall comprises one or more openings to the cavity to thereby allow acoustic energy to be damped by the cavity, wherein the insert comprises features or properties tailored to a particular turbocharger to provide accuracy as to damper characteristics for noise generated during operation of the turbocharger and wherein the insert comprises a resilient insert capable of being radially compressed, inserted into the lumen of the conduit and radially expanded to secure the insert in a location in the conduit that spans the cavity wherein the conduit comprises a ridge that spans a length of the cavity and wherein the ridge supports the insert.

2. The noise damper of claim 1 wherein the compressor housing comprises a cast compressor housing.

3. The noise damper of claim 1 further comprising a notch located directly adjacent the cavity and configured to secure the insert.

4. The noise damper of claim 3 wherein the insert comprises a wall thickness and wherein the notch comprises a depth that matches the wall thickness of the insert to thereby form a substantially continuous transition between the gas flow surface and the insert.

5. The noise damper of claim 1 further comprising a pair of notches located directly adjacent opposite ends of the cavity and configured to secure the insert.

6. The noise damper of claim 1 wherein the conduit comprises a gas flow surface at an inner diameter and a cavity that extends from the inner diameter to a larger cavity diameter.

7. The noise damper of claim 1 wherein the insert comprises a material of construction selected from a group consisting of metals, plastics and composite materials.

8. The noise damper of claim 1 wherein the insert comprises one or more openings that comprise an arc length dimension that exceeds an axial dimension of the insert.

9. The noise damper of claim 8 wherein the insert comprises one or more substantially rectangular openings having a length oriented orthogonal to a gas flow direction.

10. A compressor housing for a turbocharger, the compressor housing comprising:

a compressor scroll section;

an outlet for compressed gas;

a tailorable noise damper located in a conduit between the compressor scroll section and the outlet for compressed gas wherein the noise damper comprises a cavity formed in part by the conduit and a resilient insert disposed completely in the conduit via the outlet wherein the resilient insert spans the cavity and comprises one or more openings to the cavity and wherein the resilient insert comprises features or properties tailored to a particular turbocharger to provide accuracy as to damper characteristics for noise generated during operation of the turbocharger; and a notch located directly adjacent the cavity and configured to secure the resilient insert wherein the resilient insert comprises a wall thickness and wherein the notch comprises a depth that matches the wall thickness of the resilient insert to thereby form a substantially continuous transition between a gas flow surface of the conduit and the resilient insert.

11. The noise damper of claim 10 further comprising a pair of notches located directly adjacent opposite ends of the cavity and configured to secure the insert.

12. A method for manufacturing a compressor housing that comprises a tailorable noise damper, the method comprising:

casting a compressor housing wherein the compressor housing comprises a compressor scroll, an outlet for compressed gas, a conduit between the compressor scroll and the outlet for compressed gas and a cavity located in a wall of the conduit;

tailoring features or properties of a resilient insert to a particular turbocharger to provide accuracy as to damper characteristics for noise generated during operation of the turbocharger;

inserting the resilient insert completely into the conduit wherein the resilient insert spans the cavity and comprises one or more openings to the cavity, wherein the compressor housing further comprises a ridge that spans a length of the cavity; and supporting the resilient insert at least in part by the ridge.

13. The method of claim 12 wherein the inserting comprises compressing the resilient insert, inserting the resilient insert into the conduit via the outlet for compressed gas and allowing the resilient insert to expand in the conduit.

* * * * *